US007467888B2

(12) United States Patent
Fiene

(10) Patent No.: US 7,467,888 B2
(45) Date of Patent: Dec. 23, 2008

(54) QUICK CHANGE POWER SUPPLY

(75) Inventor: Dale E. Fiene, Algonquin, IL (US)

(73) Assignee: Ole K. Nilssen, Bonita Springs, FL (US)

( * ) Notice: Subject to any disclaimer, the term of this patent is extended or adjusted under 35 U.S.C. 154(b) by 300 days.

(21) Appl. No.: 11/027,801

(22) Filed: Dec. 31, 2004

(65) Prior Publication Data

US 2006/0145632 A1 Jul. 6, 2006

(51) Int. Cl.
*H01R 33/00* (2006.01)

(52) U.S. Cl. ..... 362/640; 362/652; 362/437; 362/439; 362/441; 362/221; 439/119; 439/701; 439/718; 439/651

(58) Field of Classification Search ..... 362/147, 362/148, 150, 404, 406, 437, 439, 441, 446, 362/640, 648, 800, 134, 221, 391, 44, 652; 315/291, 294, 254, 244, DIG. 2, DIG. 5, 315/56, 58, 61; 439/535–537, 651, 928.1, 439/929, 701, 718, 119
See application file for complete search history.

(56) References Cited

U.S. PATENT DOCUMENTS

| | | | | | |
|---|---|---|---|---|---|
| 3,590,271 | A * | 6/1971 | Peters | 307/140 |
| 3,813,579 | A * | 5/1974 | Doyle et al. | 361/46 |
| 3,931,689 | A * | 1/1976 | Shine | 40/570 |
| 4,626,747 | A | 12/1986 | Nilssen | 315/209 R |
| 4,631,648 | A | 12/1986 | Nilssen | 362/150 |
| 4,651,059 | A | 3/1987 | Nilssen | 315/182 |
| 4,667,133 | A | 5/1987 | Nilssen | 315/312 |
| 4,919,625 | A * | 4/1990 | Coutre | 439/118 |
| 5,003,227 | A | 3/1991 | Nilssen | 315/161 |
| 5,047,696 | A | 9/1991 | Nilssen | 315/312 |
| 5,239,205 | A * | 8/1993 | Hoffman et al. | 307/117 |
| 5,479,326 | A | 12/1995 | Nilssen | 362/148 |
| 5,640,069 | A | 6/1997 | Nilssen | 315/209 R |
| 5,691,603 | A | 11/1997 | Nilssen | 315/209 R |
| 5,735,710 | A * | 4/1998 | Blaauboer et al. | 439/535 |
| 5,803,579 | A * | 9/1998 | Turnbull et al. | 362/516 |
| 6,388,393 | B1 * | 5/2002 | Illingworth | 315/291 |
| 6,601,977 | B2 * | 8/2003 | Gesue | 362/392 |
| 6,808,283 | B2 * | 10/2004 | Tsao | 362/95 |
| 6,814,462 | B1 * | 11/2004 | Fiene | 362/133 |
| 6,932,624 | B1 * | 8/2005 | Hoopes et al. | 439/76.1 |
| 6,979,097 | B2 * | 12/2005 | Elam et al. | 362/148 |
| 7,102,172 | B2 * | 9/2006 | Lynch et al. | 257/79 |
| 2006/0061296 | A1 * | 3/2006 | Fiene | 315/224 |

* cited by examiner

*Primary Examiner*—Haissa Philogene

(57) ABSTRACT

A power supply module for a lighting system is directly mountable onto a special cover plate for a standard electrical junction box. The power supply module is provided with a plug assembly that mates with a socket assembly incorporated within the special cover plate. The power supply circuit provides an electronically power limited output through multi-conductor connectors. The power supply output is used to connect to luminaires using a multi-conductor cable having multi-conductor connectors that mate with the multi-conductor connectors on the power supply and the luminaires. The luminaires use a circuit to interface between the power supply output and the lamp. The special cover plate is also suitable for receiving a plug assembly incorporated within the base of a lighting base module that can provide temporary incandescent or gas-discharge lighting.

30 Claims, 5 Drawing Sheets

QUICK CHANGE POWER SUPPLY

This invention relates generally to a power supply assembly fore lighting systems and, more particularly, to a power supply assembly for ceiling lighting systems, using gas-discharge lamps or light emitting diode arrays. The one embodiment of the invention allows for an electrician to install a socketed-cover plate onto an electrical junction box. A power supply module is then added at a later time and at least in some jurisdictions by an installer that is not an electrician.

BACKGROUND OF THE INVENTION

General lighting in commercial buildings is normally provided by placing troffers or lighting panels in suspended ceilings at regular intervals when the building is built. Depending on the occupant, this may not provide for the most efficient use of the lighting system. By providing the building with temporary lighting until the space is rented or purchased, and allowing the occupant to select the lighting system most appropriate to his needs, a more optimum system can be installed. The instant invention allows the electricians to install the conduit, junction boxes and a special socketed-cover plate that can be used with a low cost lighting base module to provide temporary lighting. When the building is rented or sold, the temporary lighting can be replaced with power supply modules to power gas-discharge luminaires or light emitting diode (LED) type lighting panels. Since the power supply module merely mounts onto the socketed-cover plates via a connector there is no wiring that needs to be handled by an electrician. The wiring between the power supply module outputs and the inputs to the luminaires is also accomplished via cables with connectors.

In addition general lighting that is installed at the time the building is built as opposed to when it is occupied can also benefit from this system in that the electrician need only wire up the socketed-cover plates. Much lower cost installers can then be used to install the rest of the lighting system. In the event of a failure of a power supply module, a maintenance person can make the replacement without having to call an electrician.

SUMMARY OF THE INVENTION

Among the many objectives of this invention is the provision of improved packaging of a power supply for lighting systems that permits a power supply module to be easily connected to the building's electrical system without any training as an electrician. It is another objective of the present invention to provide a power supply for lighting systems having a low cost with simplified installation. It is another objective of the present invention to provide a power supply for lighting systems that is easily replaced in the event of a failure of a power supply. Still another objective of the present invention is to provide a power supply for lighting systems that has multiple independently switched outputs.

These and other objectives of the invention (which other objectives become clear by consideration of the specification, claims and drawings as a whole) are met by providing a power supply suitable for providing input power to a luminaire with the power supply being connected to the building's electrical system by way of a mating type connector assembly. The power supply assembly includes a socketed-cover plate assembly for mounting to an electrical junction box, and a power supply module containing a power supply circuit suitable for powering a ballasting circuit for a gas discharge lamp. The cover plate assembly includes a socket assembly with leads for connection to a source of electrical power, supplied by a utility company. The power supply module includes a plug assembly to mate with the socket assembly in the socketed-cover plate to provide input power to the power supply circuit and an output provided by way of a multi-conductor connector suitable for receiving and connecting with a mating multi-conductor connector attached to a multi-conductor cable.

BRIEF DESCRIPTION OF THE DRAWINGS

These and other features, objects and advantages of the present invention will become apparent from the following description and drawings wherein like reference numerals represent like elements in several views and in which.

DESCRIPTION OF THE PREFERRED EMBODIMENTS

Figure 1:
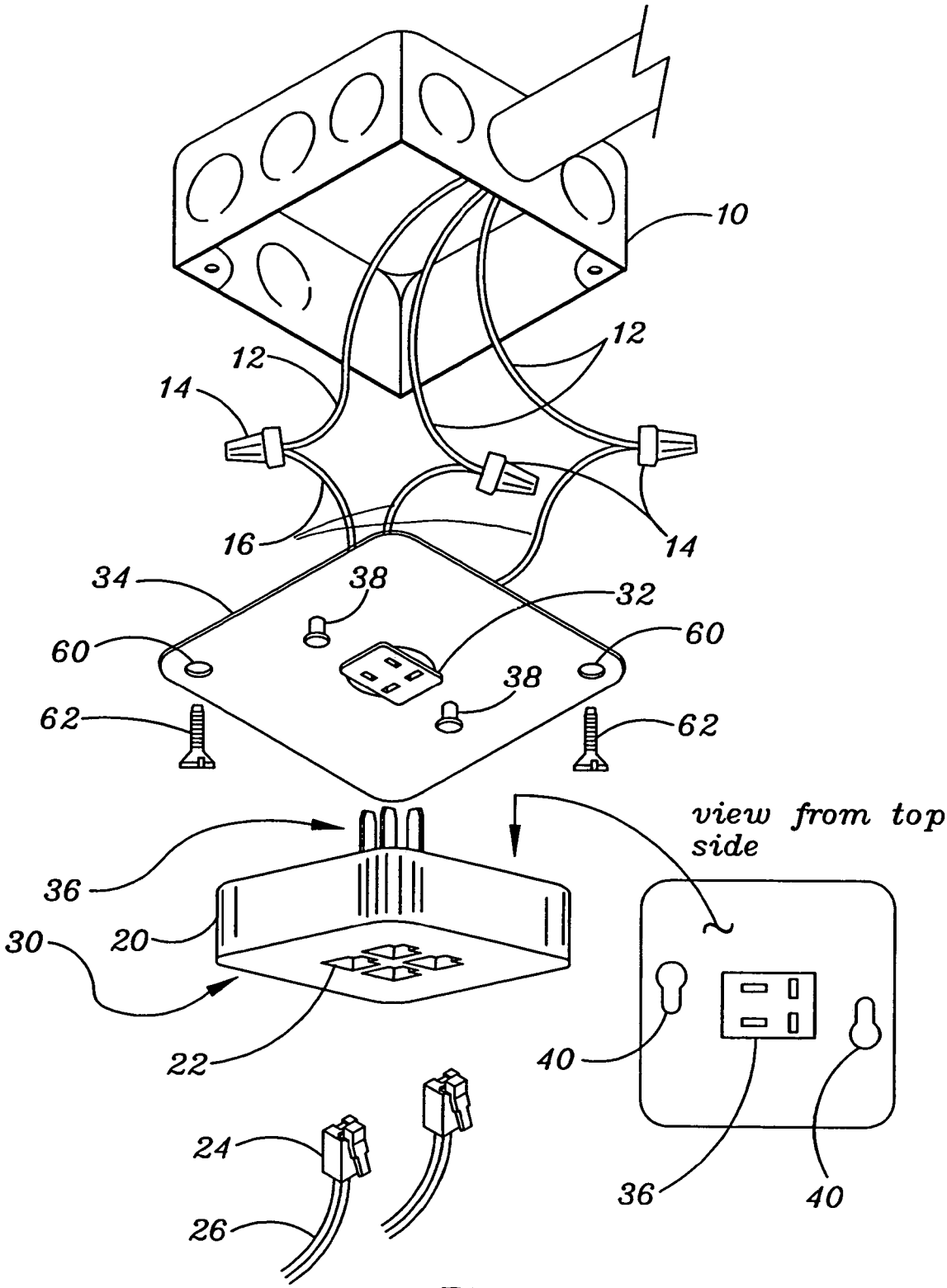
FIG. 1 depicts an exploded perspective view of how power supply module 30 plugs into swiveling cover plate 34 that mounts to an electrical junction box 10.

The instant invention overcomes the problems of the prior art by providing a power supply for lighting systems that mounts onto a special cover plate for an electrical junction box. The special cover plate includes a socket assembly and is prewired into the buildings electrical wiring, generally by an electrician. At a later time the lighting system can be added by someone with less skill than an electrician since the lighting system simply plugs together. The power supply is provided with a plug assembly that at the time of installation of the lighting system engages the socket of the special cover plate and makes electrical contact between the input to the power supply and the buildings electrical wiring. The power supply is then mechanically held in place by fasteners. This reduces the cost of the installed system by allowing the lighting system, including the power supply module, to be added when the building is ready to be occupied and the installation does not need to be done by an electrician since the lighting system simply plugs together without any further need to make any direct wiring connections to the building's electrical wiring. In addition, during the time prior to the installation of the final lighting system, a lighting base module can be installed. Typically the lighting base module will simply provide incandescent lighting which can be removed and reused on another job site when the permanent lighting system is installed.

In a first embodiment (FIG. 1), a power supply module 30 includes a power supply circuit for a lighting system. The power supply circuit is mounted in an enclosure 20 that includes keyhole slots 40 and a plug assembly 36 that allows the power supply module to be mounted directly onto a swiveling socket cover plate 34. The swiveling socket cover plate which mounts on a junction box 10 includes a swiveling socket assembly 32 that has socket leads 16 which are connected to the utility power source with branch circuit leads 12 of a building's electrical wiring. The enclosure of the power supply module includes a multi-conductor connector 22 that accepts a mating multi-conductor connector 24 provided on the end of a multi-conductor cable 26. The multi-conductor cable is typically then run to luminaires where it is used to provide power to ballasting circuits for gas-discharge lamps located within a luminaire or light-emitting diode (LED) lighting panels. By using a power supply circuit that is electronically power limited (100 VA or less for Class 3 wiring), the National Electrical Code permits the use of cables connecting the power supply to the luminaire without the need to run the wiring in conduit or flexible armored tubing. The power supply module is mounted onto the cover plate by inserting the terminals of the plug assembly 36 into the swiveling socket assembly 32 and aligning the retaining posts 38 on the cover plate with the large end of the keyhole slots 40 on the backside of the power supply enclosure 20. By seating the plug in the socket and then rotating the power supply module the module is supported by the cover plate. The components of the power supply circuit that dissipate the most heat, such as the power transistors, power diodes, transformers and inductors are mounted onto or close to the inside of the outer walls of the enclosure if possible to minimize the temperature rise and thus thermal stress on all the components of the power supply circuitry. This will greatly increase the life of the components. For units that are unable to have their power dissipating components mounted directly to the enclosure, improvement in the reduction of component thermal stress can be achieved by adding thermally conductive potting compound to the unit, particularly in the area of the components with the greatest amount of dissipation to thermally couple the component to the enclosure. The available power that can be supplied from a unit roughly the size shown in FIG. 1 (4"×4") depends to a great extent on the efficiency of the power supply circuit topology chosen, but a unit that size should be able to handle approximately 200 watts of output power.

For a second embodiment (FIG. 2), a power supply for higher power capability or less efficient topologies has at least one side that extends beyond the sidewalls of the electrical junction box to which it mounts. As the output capacity increases or less efficient topologies are used, physically larger components are required particularly for power inductors and transformers. There is often a restriction with respect to how far the front surface of the power supply assembly can extend from the wall or ceiling to which the junction box is attached, therefore the height of the enclosure of the power supply assembly is limited and the volume needs to be increased by increasing the length or width or both. The enclosure 20 of power supply module 30 extends beyond the dimensions of the junction box. This embodiment shows the power supply module being supported with power supply mounting screws 18.

A feature that can be provided with any of these embodiments is the capability to provide two or more separate outputs that can be switched on and off independently. This can be accomplished in several ways. The simplest, although likely not the most cost effective, way is to simply have two substantially separate power supply circuits built within the same enclosure. By applying line voltage between input power leads 16*a* and 16*b*, multi-conductor connector 22*a* is energized by a first power supply circuit. By applying line voltage between input power leads 16*a* and 16*c*, multi-conductor connector 22*b* is energized by a second power supply circuit. By applying line voltage simultaneously between input power leads 16*a* and 16*b*, and 16*a* and 16*c*, both multi-conductor connectors 22*a* and 22*b* are energized. Another variation on this feature is to use a multi-conductor connector 22 with four terminals and use the outer pair for one circuit's output and the inner pair for a second circuit's output. The outer pair being energized, for example, when line voltage is applied between input power leads 16*a* and 16*b*, and the inner pair being energized when line voltage is applied between input power leads 16*a* and 16*c*. With either approach the output circuits can be electrically isolated from one another or share a common connection. The power available from each output can be set to different limits.

A more cost effective alternative to using two separate power supply circuits for power supplies that have a high-frequency AC voltage output is to use a single DC power supply to provide filtered DC voltage to two separate high-frequency inverters. The power to the DC supply is brought in through two separate rectifier circuits by the three input power leads. A circuit is used to sense which of the leads is supplying power to the power supply module. The filtering of the DC voltage should be adequate to limit the modulation of the inverter AC output voltage to less than 50%. If power is applied between input power leads 16*a* and 16*b*, a first inverter circuit is enabled and multi-conductor connector 22*a* is energized. If power is applied between input power leads 16*a* and 16*c*, a second inverter circuit is enabled and multi-conductor connector 22*b* is energized. Corresponding topologies can be used for units requiring DC output voltage to accomplish similar results.

A further variation on this embodiment is for use with for instance three lamp luminaires. By providing power to the ballast for one of the three lamps from one of the two power supplies in the above described power supply module and providing power to the ballast for the other two of the three lamps from a second of the two power supplies in the above described power supply module, three separate levels of light can be chosen by switched onto input power leads 16*a* and 16*b* for $\frac{1}{3}^{rd}$ of full light output, 16*a* and 16*c* for $\frac{2}{3}^{rds}$ of full light output, or 16*a* and 16*b*, plus 16*a* and 16*c* for full light output. Using this approach the maximum capacity of one of the power supply circuits can be designed to be one-half that of the other power supply circuit.

Figure 3:
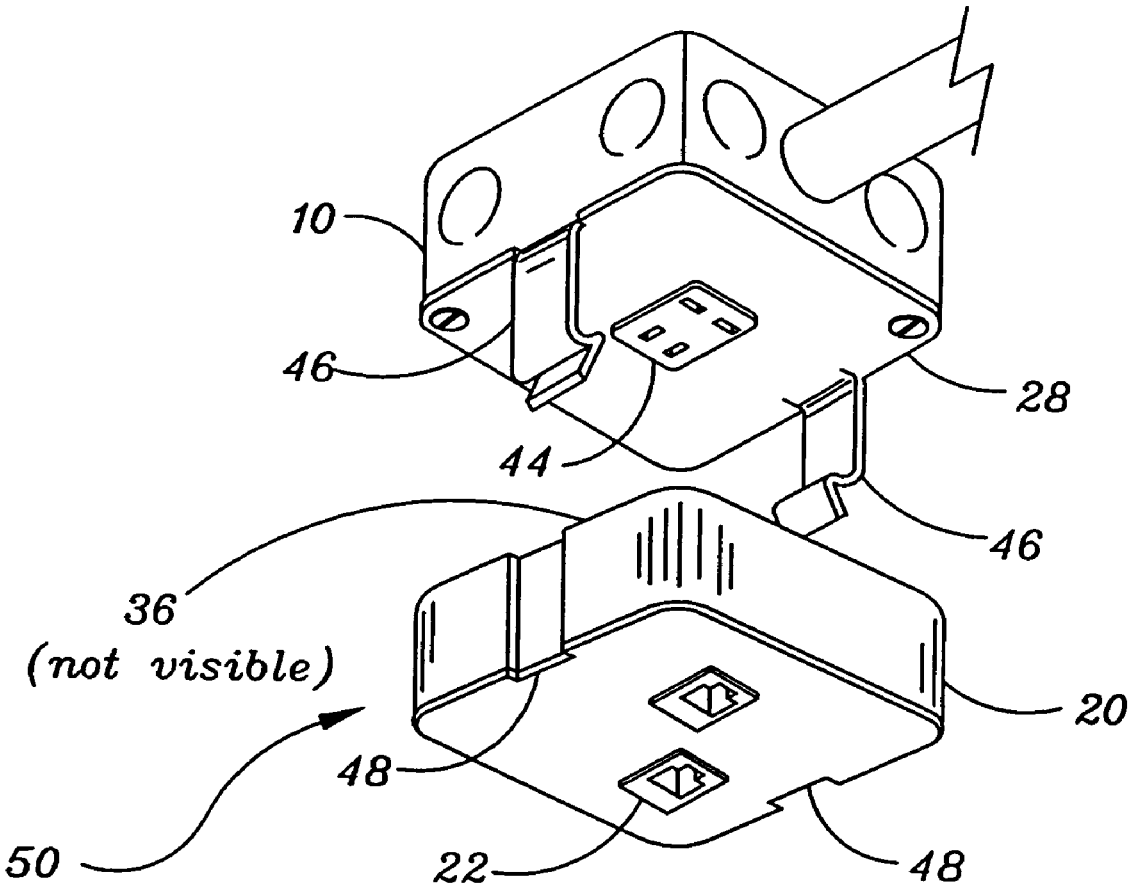
FIG. 3 depicts an exploded perspective view of how a quick-change power supply module 50 plugs into socketed cover plate 28 that is mounted to an electrical junction box 10.

In the embodiment shown in FIG. 3 the quick-change power supply module 50 is supported by retaining clips 46 provided on the socketed cover plate 28. The power supply module is installed by merely arranging the plug assembly 36 to properly align with the socket assembly 44 and pushing the retaining clips through the channels 48 in the enclosure 20.

Figure 4:
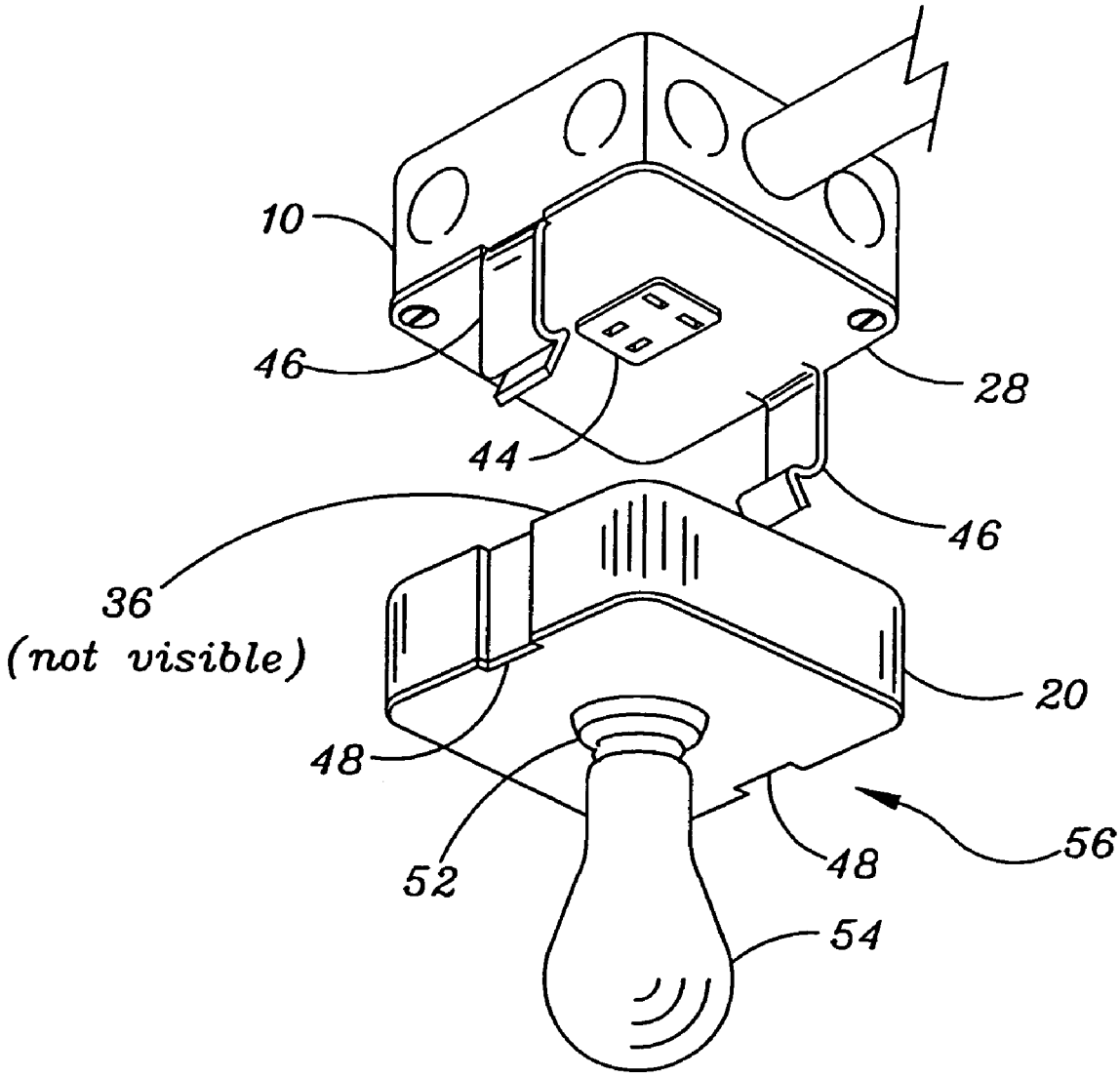
FIG. 4 depicts an exploded perspective view of how a lighting base module 56 plugs into socketed cover plate 28 that is mounted to an electrical junction box 10.

FIG. 4 shows how a lighting base module can be mounted on the same cover plate as a quick-change power supply module. The lighting base module is used to provide lighting until the space is occupied and the final lighting layout is determined. The lighting base assemblies are then replaced with the quick-change power supplies and the desired luminaires are installed.

In another embodiment (see FIG. 5) a pig-tailed socket assembly 64 is wired into the branch circuit leads 12 of a buildings electrical wiring system. A power supply module provided with a plug assembly 36 can be plugged into the pig-tailed socket assembly. The mounting plate 42 provided as part of the power supply module provides the cover to the junction box 10. As in the previous embodiment for new construction a lighting base module consisting of a cover plate with a socket on one side wired to a plug assembly on the other can be used for inexpensive temporary lighting and latter replaced with a power supply module and luminaires chosen by the new owner or tenant of the space.

Referring now to FIG. 1, extending from the backside of swiveling socket cover plate 34 are socket leads 16 for connection to branch circuit leads 12 using twist-on wire connectors 14. The socket leads 16 connect to the various terminals swiveling socket assembly 32. Swiveling socketed cover plate 34 contains cover plate mounting holes 60 for mounting the swiveling socketed cover plate 34 to junction box 10 using cover plate mounting screws 62. Power supply module 30 has an enclosure 20 with multi-conductor connector 22 located on at least one surface. The enclosure 30 also includes a plug assembly 36 for insertion into and electrical connection with swiveling socket assembly 32. Swiveling socket cover plate 34 is provided with two retaining posts 38 which engage with keyhole slots 40 during mounting. The multi-conductor connector 22 engage with mating multi-conductor connector 24 attached to multi-conductor cable 26.

Figure 2:
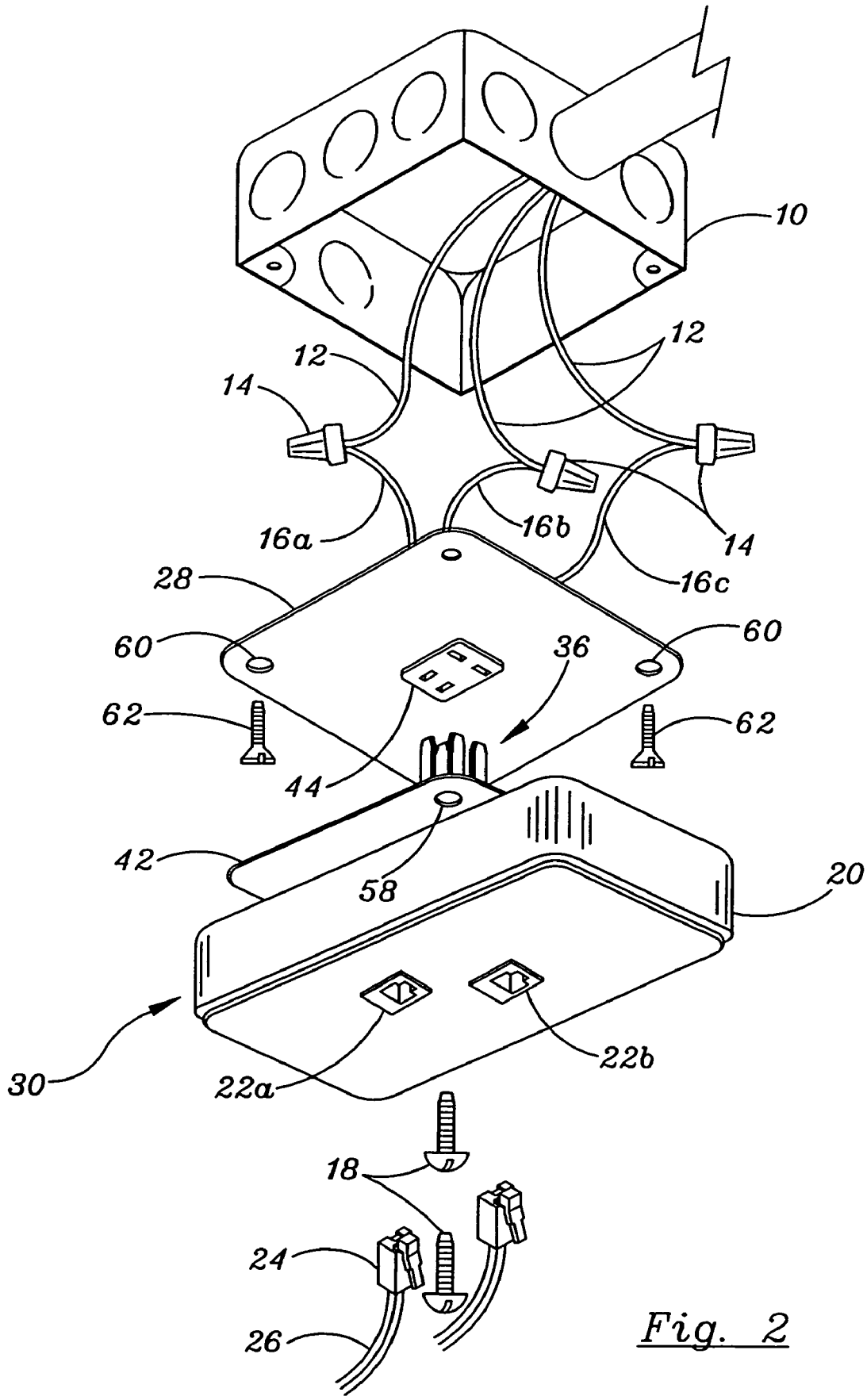
FIG. 2 depicts an exploded perspective view of how an oversized power supply module 30 plugs into socketed cover plate 28 that mounts to an electrical junction box 10.

In FIG. 2, extending from the backside of socketed cover plate 28 are socket leads 16 for connection to branch circuit leads 12 using twist-on wire connectors 14. The socket leads 16 connect to the various terminals socket assembly 44. Socketed cover plate 28 contains cover plate mounting holes 60 for mounting the socketed cover plate 28 to junction box 10 using cover plate mounting screws 62. Power supply module 30 has an enclosure 20 with multi-conductor connector 22 located on at least one surface. The enclosure 30 also includes a plug assembly 36 for insertion into and to make electrical connection with socket assembly 44. Socketed cover plate 28 is provide with two power supply mounting holes 58 which are used for mechanically supporting the power supply module using power supply mounting screws 18 during power supply mounting. The multi-conductor connector 22 engage mating multi-conductor connector 24 attached to multi-conductor cable 26.

In figure 3, extending from the backside of quick-change power supply module 50 is a plug assembly 36 (not visible). The front side of the quick-change power supply module 50 includes at least one multi-conductor connector 22. Channels 48 are provided on alternate sides of the enclosure 20 to receive the retaining clips 46 provided as part of the socketed cover plate 28. The socketed cover plate 28 is mounted on a junction box 10 and includes a socket assembly 44.

In figure 4, a lighting base module 56 includes a plug assembly 36 that extends from the backside (not visible). The front side of the lighting base module 56 is provided with an Edison base socket 52 to receive an incandescent lamp 54. Channels 48 are provided on alternate sides of the enclosure 20 to receive the retaining clips 46 provided as part of the socketed cover plate 28. The socketed cover plate 28 is mounted on a junction box 10 and includes a socket assembly 44.

Figure 5:
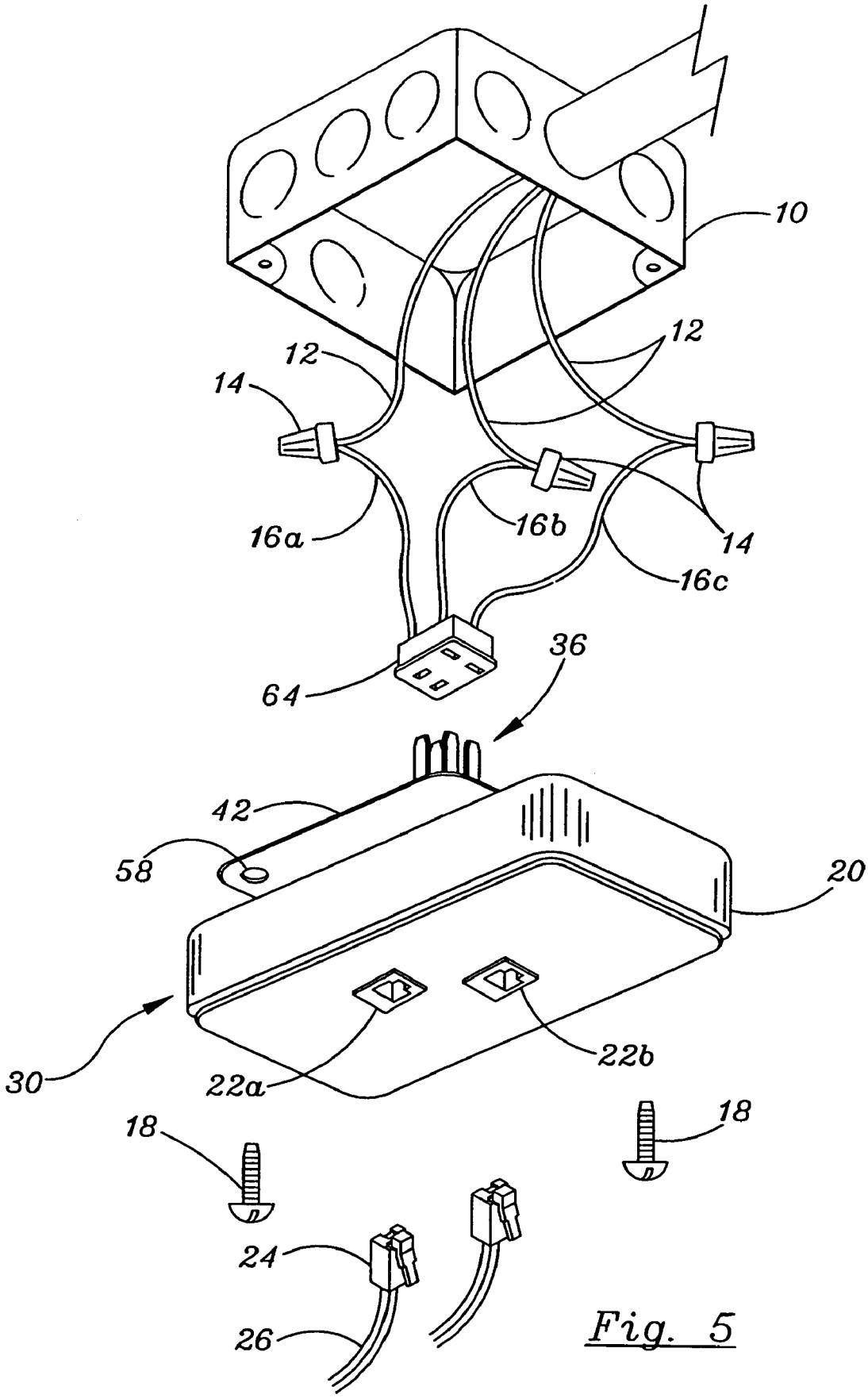
FIG. 5 depicts an exploded perspective view of how a power supply module 30 plugs into a pig-tailed socket assembly 64 that is wired through a junction box 10.

In figure 5, the socket leads 16 of a pig-tailed socket assembly 64 are wired to the branch circuit leads 12 using twist-on wire connectors 14. Plug assembly 36 extends from the mounting plate 42 of power supply module 30. Power supply mounting holes 58 are provided on alternate corners to receive power supply mounting screws 18 for attachment to junction box 10.

There are numerous variations that can be applied to any one of the above embodiments, for instance the description discusses the use of a power supply circuit, which provides a high-frequency voltage source, typically greater than 10 to 20 kilo-Hertz, but lighting systems can also be powered from high-frequency current sources as well as direct current voltage and current sources. When multiple multi-conductor connectors are use on a power module with a voltage power source and without independent switching of the outputs, the multi-conductor connectors can be wired in parallel whereas multi-conductor connectors for a current source need to be wired in series. The electrical box shown in the figures is representative of a standard 4×4 electrical box, but the power supply assembly can be made to attach to a 2×4, an octagon box or any other suitable electrical box. The drawings depict the electrical boxes being mounted overhead, but they can also be mounted vertically on walls or attached to other structural elements of a building. The plug assembly and the socket assembly can be interchanged if the plug assembly is provided with a protective housing to avoid a shock hazard. The lighting base module 56 in FIG. 4 can also be used for powering a gas-discharge lamp, such as, a fluorescent, metal halide or high pressure sodium by packaging an appropriate ballasting circuit within the lighting base module. Although in the preferred embodiment the lighting base module is used for temporary lighting, the lighting base module mounted on a socketed-cover plate can be used as a permanent lighting source for many applications. The reduction in the difficulty of supporting a relatively heavy luminaire while making the electrical connections and the ease of replacement or upgrading can justify the added hardware cost. The output switching capability can be incorporated into any of the power supply mounting techniques shown. The pig-tailed leads of the pig-tailed socket assembly 64 can be replaced, for instance, with a socket having receptacles to receive the branch circuit leads.

This application; taken as a whole with the abstract, specification, claims, and drawings being combined; provides sufficient information for a person having ordinary skill in the art to practice the invention as disclosed and claimed herein. Any measures necessary to practice this invention are well within the skill of a person having ordinary skill in this art after that person, has made a careful study of this disclosure.

Because of this disclosure and solely because of this disclosure, modification of this method and device can become clear to a person having ordinary skill in this particular art. Such modifications are clearly covered by this disclosure.

I claim:

1. A power supply assembly comprising: a cover for an electrical junction box, and an enclosure;

the cover having a front side and a back side;

the cover also including a socket with a receptacle for receiving a plug assembly on a first side and having at least two input power leads or terminals connected to the socket on a second side;

the at least two input power leads or terminals being suitable for connection with electrical power supplied by a power utility;

the socket being mounted in the cover such that the first side of the socket corresponds with the front side of the cover and the second side of the socket corresponds to the back side of the cover;

the enclosure enclosing an electronic power supply circuit and includes a plug assembly suitable to engage and make electrical contact with the socket provided in the cover; and the enclosure including at least one multi-conductor connector suitable for receiving and making electrical connection to a mating multi-conductor connector connected to a multi-conductor cable.

2. The power supply assembly of claim 1 wherein the power supply assembly is for a ceiling lighting system.

3. The power supply assembly of claim 1 wherein the power supply assembly is for a gas-discharge lighting system.

4. The power supply assembly of claim 1 wherein the at least one multi-conductor connector has two terminals;

an alternating voltage existing between the two terminals;

the alternating voltage having a frequency; and the frequency being greater than 10 kilohertz.

5. The power supply assembly of claim 4 wherein the high-frequency voltage is modulated at a second frequency;

the second frequency being significantly lower than 10 kilohertz; and the percent of modulation being less than 100%.

6. The power supply assembly of claim 1 wherein the at least one multi-conductor connector has two terminals; and a DC voltage exist between the two terminals.

7. The power supply assembly of claim 1 wherein output power is drawn from the multi-conductor connector; and the output power is electronically limited by the power supply circuit.

8. The power supply assembly of claim 7 wherein the output power is electronically limited to be less than 250 Watts or Volt-Amperes.

9. The power supply assembly of claim 1 wherein the at least one multi-conductor connector is at least two multi-conductor connectors.

10. The power supply assembly of claim 1 wherein the at least one multi-conductor connector is at least two multi-conductor connectors; and one member of the set of at least two multi-conductor connectors is electrically connected to a second member of the set of at least two multi-conductor connectors.

11. The power supply assembly of claim 1 wherein the at least one multi-conductor connector is at least two multi-conductor connectors;

the at least two multi-conductor connectors have terminals; and the terminals of a first connector of the set of at least two multi-conductor connectors are connected in parallel with the terminals of a second connector of the set of at least two multi-conductor connectors.

12. The power supply assembly of claim 1 wherein the at least one multi-conductor connector is at least two multi-conductor connectors;

the at least two multi-conductor connectors have terminals; and the terminals of a first connector of the set of at least two multi-conductor connectors are connected in series with the terminals of a second connector of the set of at least two multi-conductor connectors.

13. The power supply assembly of claim 1 wherein the at least one multi-conductor connector is at least two multi-conductor connectors; and the first member of the set of at least two multi-conductor connectors has no direct current connection to the second member of the set of at least two multi-conductor connectors.

14. The power supply assembly of claim 13 wherein the first member is electronically limited to a first power level; and the second member is electronically limited to a second power level.

15. The power supply assembly of claim 14 wherein the first power level is substantially the same as the second power level.

16. The power supply assembly of claim 14 wherein the first power level is substantially the different than the second power level.

17. The power supply assembly of claim 14 wherein the first power level is approximately twice the second power level.

18. The power supply assembly of claim 1 wherein the at least one multi-conductor connector is at least two multi-conductor connectors;

the at least two input power leads or terminals is at least three input power leads or terminals;

when power is applied between a first input power lead or terminal and a second input power lead or terminal a first multi-conductor connectors is energized; and when power is applied between a first input power lead or terminal and a third input power lead or terminal a second multi-conductor connectors is energized.

19. The power supply assembly of claim 18 wherein the power available from the first multi-conductor connectors is electronically limited to a first power level; and the power available from the second multi-conductor connectors is electronically limited to a second power level.

20. The power supply assembly of claim 19 wherein the first power level is substantially the same as the second power level.

21. The power supply assembly of claim 19 wherein the first power level is substantially different than the second power level.

22. The power supply assembly of claim 19 wherein the first power level is approximately twice the second power level.

23. The power supply assembly of claim 1 wherein the at least one multi-conductor connector has at least four terminals;

the at least two input power leads or terminals is at least three input power leads or terminals;

when power is applied between a first input power lead or terminal and second input power lead or terminal, output power is available between a first pair of terminals within the at least one multi-conductor connectors; and when power is applied between a first input power lead or terminal and third input power lead or terminal, output power is available between a second pair of terminals within the at least one multi-conductor connectors.

24. The power supply assembly of claim 1 wherein the enclosure has a certain height, length, and width;

the power supply being mounted on an electrical junction box;

the electrical junction box has a certain height, length, and width; and the length of the power supply exceeding either the length the width or the length and width of the electrical junction box.

25. The power supply assembly of claim 24 wherein the length and width of the electrical junction box are substantially equal.

26. The power supply assembly of claim 1 wherein the power supply assembly is for a lighting system.

27. The power supply assembly of claim 1 wherein the power supply assembly is for a lighting system that includes light emitting diodes as a source of illumination.

28. The power supply assembly of claim 1 wherein the power supply assembly is held in place on the cover by way of at least one retaining clip.

29. The power supply assembly of claim 1 wherein the power supply assembly is held in place on the cover by way of at least one screw.

30. The power supply assembly of claim 1 wherein the power supply module is held in place on the cover by way of inserting the plug assembly into the socket and rotating the enclosure relative to the cover.

* * * * *